US007389899B2

(12) United States Patent
Johnson

(10) Patent No.: US 7,389,899 B2
(45) Date of Patent: Jun. 24, 2008

(54) FLASHLIGHT HOLSTER

(76) Inventor: Andrew L. Johnson, P.O. Box 134, Rupert, ID (US) 83350

( * ) Notice: Subject to any disclaimer, the term of this patent is extended or adjusted under 35 U.S.C. 154(b) by 552 days.

(21) Appl. No.: 10/954,081

(22) Filed: Sep. 30, 2004

(65) Prior Publication Data

US 2006/0065689 A1 Mar. 30, 2006

(51) Int. Cl.
*F41C 33/02* (2006.01)

(52) U.S. Cl. ..... 224/675; 224/914

(58) Field of Classification Search ..... 224/675, 224/190, 192, 198, 200, 660, 914, 930
See application file for complete search history.

(56) References Cited

U.S. PATENT DOCUMENTS

| | | | | | |
|---|---|---|---|---|---|
| 3,252,639 | A | * | 5/1966 | Sloan | 224/243 |
| 3,923,214 | A | * | 12/1975 | Kippen | 224/243 |
| 4,627,558 | A | * | 12/1986 | Bianchi et al. | 224/238 |
| 4,828,154 | A | * | 5/1989 | Clifton, Jr. | 224/661 |
| 5,018,654 | A | * | 5/1991 | Rogers et al. | 224/244 |
| 5,150,825 | A | * | 9/1992 | Nichols | 224/243 |
| 5,263,619 | A | * | 11/1993 | Shoemaker | 224/240 |
| 5,443,392 | A | | 8/1995 | Hodges et al. | |
| 5,593,074 | A | | 1/1997 | Matthews | |
| 5,711,468 | A | | 1/1998 | Shoemaker | |
| 5,839,630 | A | | 11/1998 | Dunstan et al. | |
| D405,258 | S | | 2/1999 | Newboult, Jr. | |
| 5,931,358 | A | * | 8/1999 | Rogers | 224/243 |
| 6,059,157 | A | | 5/2000 | Parsons et al. | |
| 6,575,343 | B2 | * | 6/2003 | Mossman | 224/198 |
| 2004/0084494 | A1 | | 5/2004 | Gilliam | |

OTHER PUBLICATIONS

"Flashlight Holsters & Pouches," Filmtools, Shop.store.yahoo.com/cinemasupplies/flasholpouc.html, 3 pages printed from the Internet Aug. 27, 2004.

"Flashlight Holders," *Cops Plus*, copsplus.com/flashlightholders.php, 3 pages printed from the Internet Aug. 27, 2004.

"Leather Holsters," Surfire, surefire.com/maxexp/main/co_disp/displ/carfnbr/153/sesent/00, and surefire.com/maxexp/main/co_disp/displl/pgrfnbr/16/sesent/00, 4 pages printed from the Internet Sep. 1, 2004.

* cited by examiner

*Primary Examiner*—Nathan J Newhouse
*Assistant Examiner*—Margaret Olson
(74) *Attorney, Agent, or Firm*—Richard C. Litman

(57) ABSTRACT

A holster is tailored to receive articles of cylindrical configuration, such as flashlights, pepper spray cans, collapsible batons, etc., provided the articles have similar diameters for a given holster. The holster provides for adjustable tension to be placed on the article in the holster and forms a generally cylindrical cavity drawn to a smaller diameter collar spaced upward from its lower end upon which the tail or the bezel of a flashlight may rest to provide additional protection to the bezel. The holster may form a generally cylindrical cavity extending the full length of the holster. The holster is configured to hold the flashlight at a forward or backward angle for smooth, ergonomic draw of the light by the user. A one-way snap strap is provided for attachment over waist belts of a variety of widths.

9 Claims, 6 Drawing Sheets

FLASHLIGHT HOLSTER

BACKGROUND OF THE INVENTION

1. Field of the Invention

The present invention relates to holsters. More particularly, the present invention relates to belt-mounted holsters for a small flashlight or the like.

2. Description of the Related Art

The use of relatively small flashlights is increasing as compact models providing light output equal to earlier large models are becoming available. Law enforcement officers commonly carry a variety of items on their waist belt in holsters and pouches. Belt clip-on and belt-mounted holsters and pouches for compact flashlights are available, however, they typically loosely hold the flashlight or are made for a specific flashlight. The clip-on holsters may easily shift relative to the belt or other clothing to which it is fastened. Many have a fastened cover making it clumsy for the user to retrieve for use. They also carry the flashlight vertically relative to the user. It would be desirable to provide a holster which is securely fastened to a law enforcement officers' belt and is adjustable for a variety of similarly sized flashlights. It would also be desirable to provide a holster which exerts adjustable tension on the cylindrical body or handle of the flashlight, keeping it secure but quickly available for grasping by the user. It would also be desirable to provide a holster securely positioning the flashlight at a convenient angle relative to the waist belt for ease in grasping and removal for use. Such a holster would reliably hold the flashlight at a consistent place and angle relative to the belt, making it easily grasped and drawn for use by an officer in an emergency.

Thus a flashlight holder solving the aforementioned problems is desired.

SUMMARY OF THE INVENTION

The flashlight holster of the present invention is preferably made of leather and is tailored to receive articles of cylindrical configuration, such as flashlights, pepper spray cans, collapsible batons, etc., provided the articles have similar diameters for a given holster. The holster provides for adjustable tension to be placed on the article such as a flashlight, keeping the article secure, while making it easily withdrawn from the inventive holster. The holster is designed to secure to the user's waist belt at the user's left side or right side, close to the body for maximum security and concealment. The holster is configured to hold the flashlight at a forward or backward angle for smooth, ergonomic draw of the light by the user. A one-way snap strap is provided for attachment over waist belts of a variety of widths.

In one configuration, the leather holster forms a generally cylindrical leather cavity drawn to a smaller diameter collar spaced upward from its lower end upon which the tail or the bezel of a flashlight may rest to protect the tail switch of the flashlight from being accidentally pressed when carried with the bezel up and to provide additional protection to the lens when carried with the bezel down. This embodiment has a narrowed lower end to secure cylindrical articles. Flashlights having a "twist-on" bezel may be turned on while the flashlight remains in the holster as desired. In another embodiment the leather holster forms a generally cylindrical leather cavity extending the full length of the holster, the holster having a narrowed lower end to secure cylindrical flashlights or other articles.

It is an aspect of the invention to provide improved elements and arrangements thereof for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
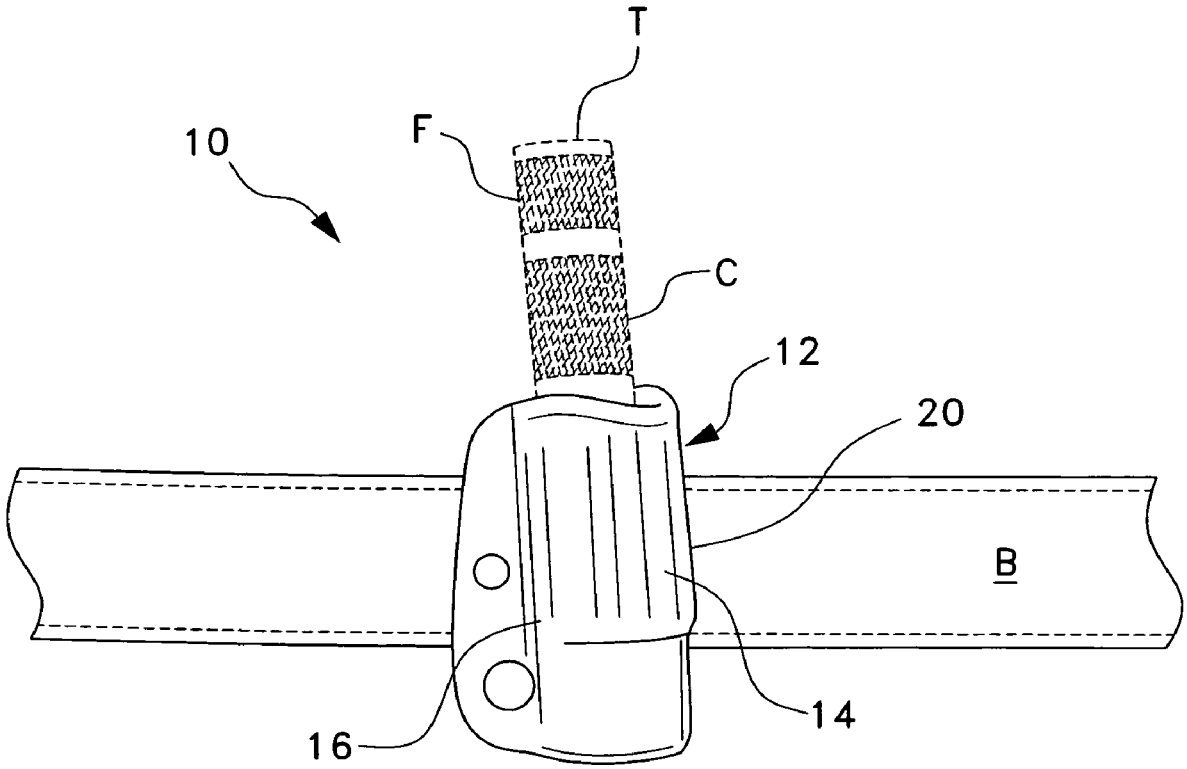
FIG. 1 is an environmental, elevational view of a flashlight holster according to the present invention.

The present invention is a holster for elongate articles such as a small flashlight, pepper spray can, collapsible baton, or the like for wear on the waist belt of a law enforcement officer.

Referring to the Figures, there is shown a flashlight holster system referred to generally by reference No. 10. Flashlight holster system 10 has a holster 12 of relatively stiff leather or plastic material. A flashlight F has a tail end T, a cylindrical or hexagonal casing C and a bezel BZ. Holster 12 has a front cylindrical portion 14 and has an outer side 16, an inner side 18 worn next to belt B, and a front portion 20. Inner side 18 has an upper end 22 to which a belt strap 24 (see FIG. 3) is attached along inner side 18 for attachment over belt B worn by a law enforcement officer O. Belt strap 24 has an upper portion 26 and a lower portion 28, the upper portion 26 being attached by conventional fasteners or rivets 30 or by stitching 64 to the inner side upper end 22 of holster 12. The inner side upper end 22 may be even with outer side upper end 34 or extend above outer side upper end 34 and the length of belt strap 24 may be selected to be coextensive therewith to fit a particular width of belt B. The belt strap lower portion 28 bears a releasable fastener such as a one-way snap head portion of a snap 32 for selective attachment to the inner side closure portion 40 of inner side 18 of holster 12 (see below).

Figure 2:
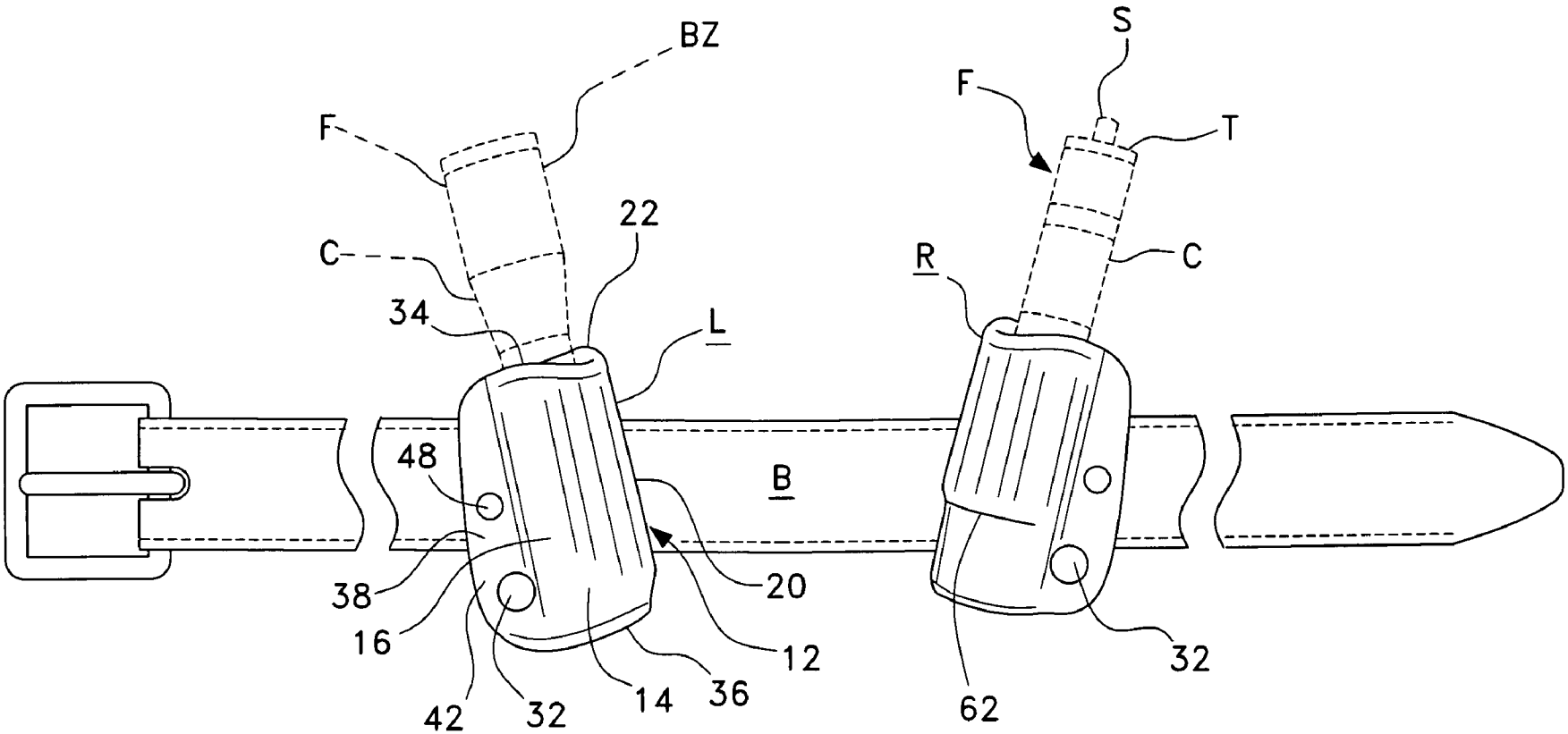
FIG. 2 is an outside elevational view of left and right versions of the flashlight holster of the flashlight holster of FIG. 1.
Figure 3:
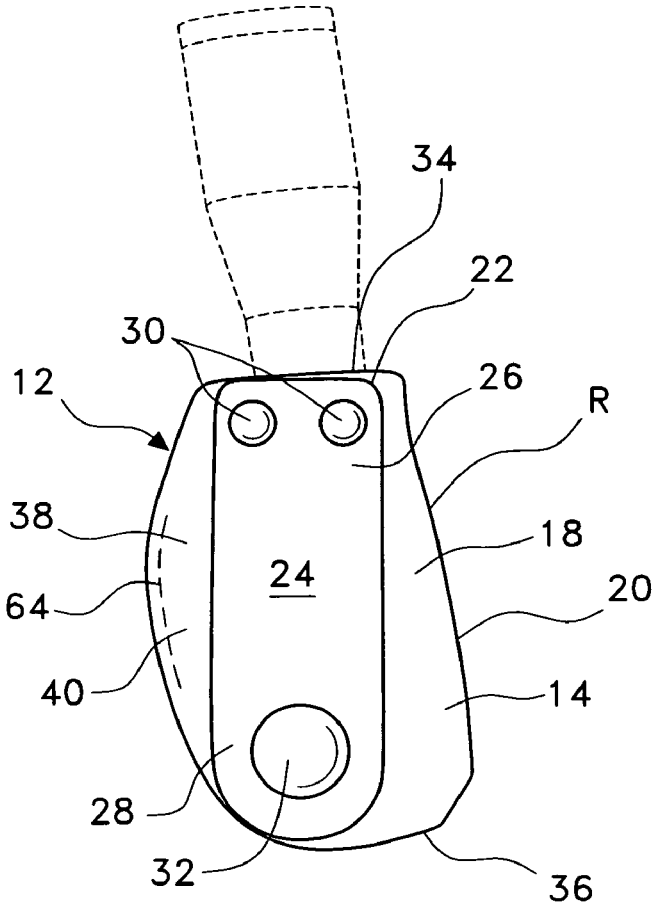
FIG. 3 is a belt side elevational view of a left-side version of the flashlight holster of FIG. 1.
Figure 4:
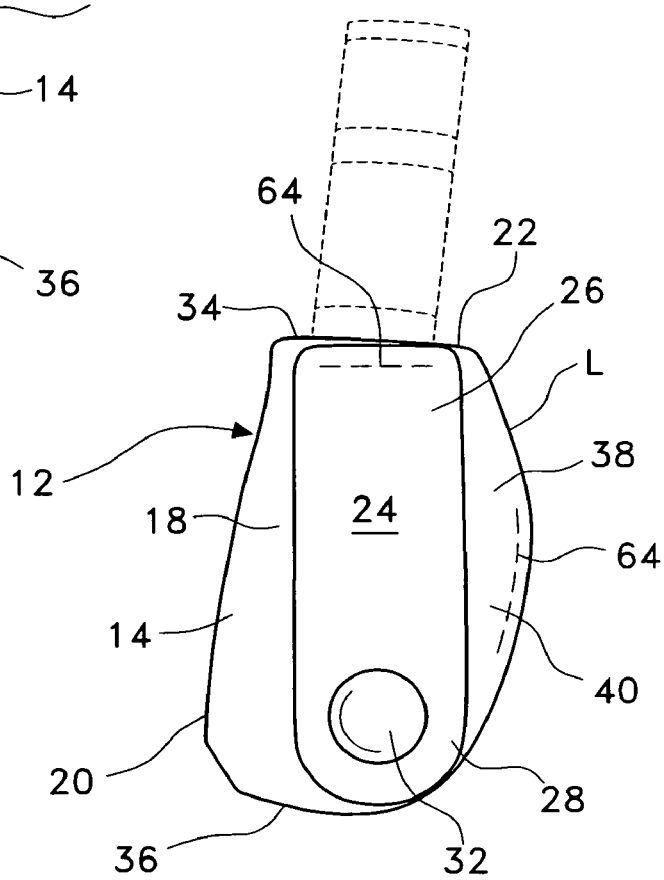
FIG. 4 is a belt side elevational view of a right-side version of the flashlight holster of FIG. 1 fastened with sewn stitches.

As seen in FIGS. 3 and 4, belt strap 24 is mounted at a rearward cant relative to the axis of the front cylinder portion 14, thus giving a flashlight barrel a forward rake (see FIG. 3) when mounted on the belt B. This forward rake is at an acute angle to vertical, preferably between about 20 to 25 degrees from vertical but may vary up to about 45 degrees from vertical. As is shown in FIG. 2, holster 12 may be embodied in mirror image left L and right R configurations. A left configuration holster has a forward rake when worn on belt B on the left side of a user and a right configuration holster has a forward rake when worn on belt B on the right side of a user. This allows for a smooth ergonomic draw of the flashlight F by either hand. These positions may be reversed if the user desires a rearward rake to the flashlight handle.

Holster 12 has an inward-tapered lower end 36 of holster front cylindrical portion 14. Holster 12 has a generally triangular rear closure portion 38 consisting of an inner side closure portion 40 and an outer side closure portion 42 through which is secured a closure portion fastener such as rivet 44.

Figure 5:
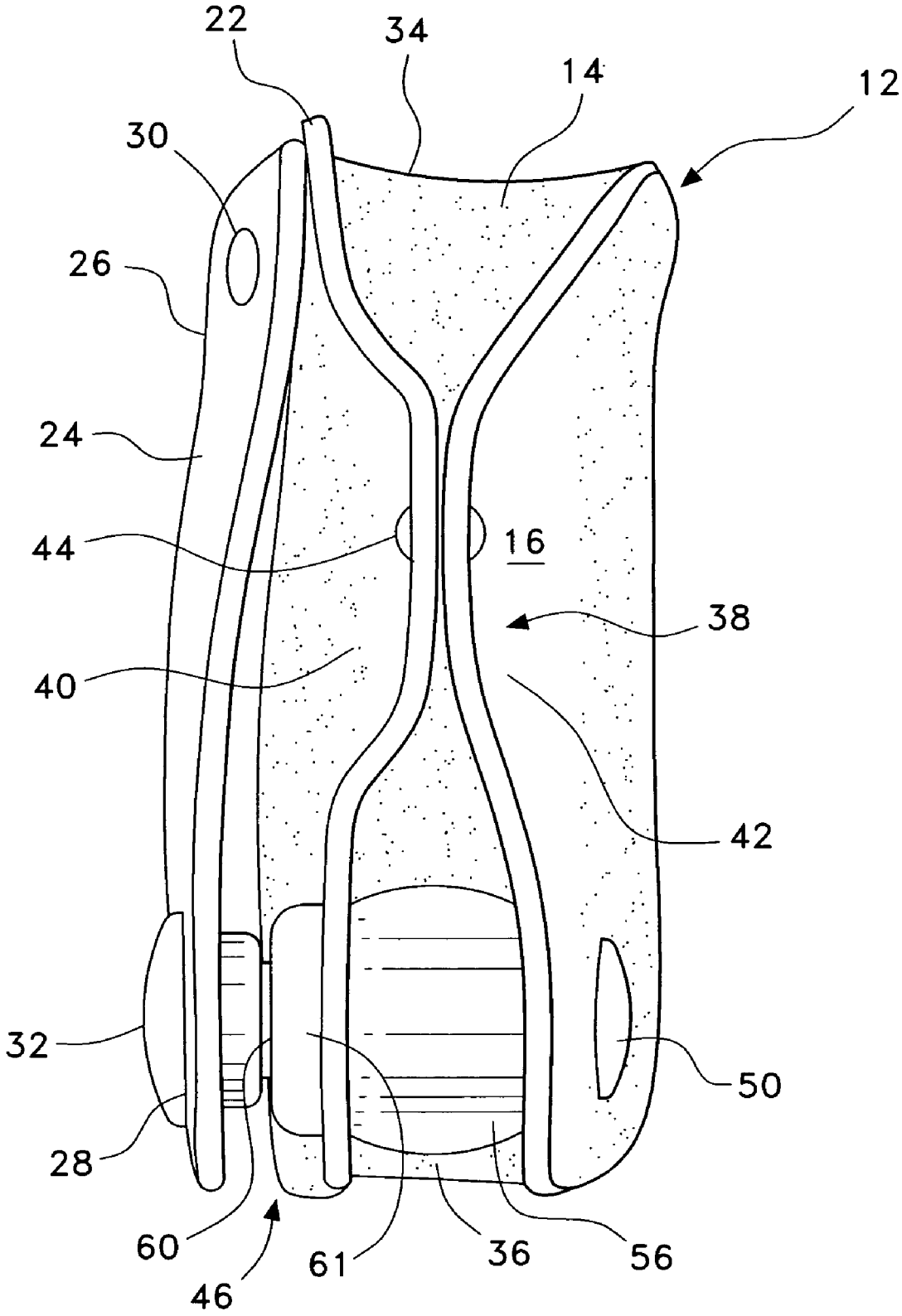
FIG. 5 is a rear elevation view of the holster of FIG. 1.
Figure 6:
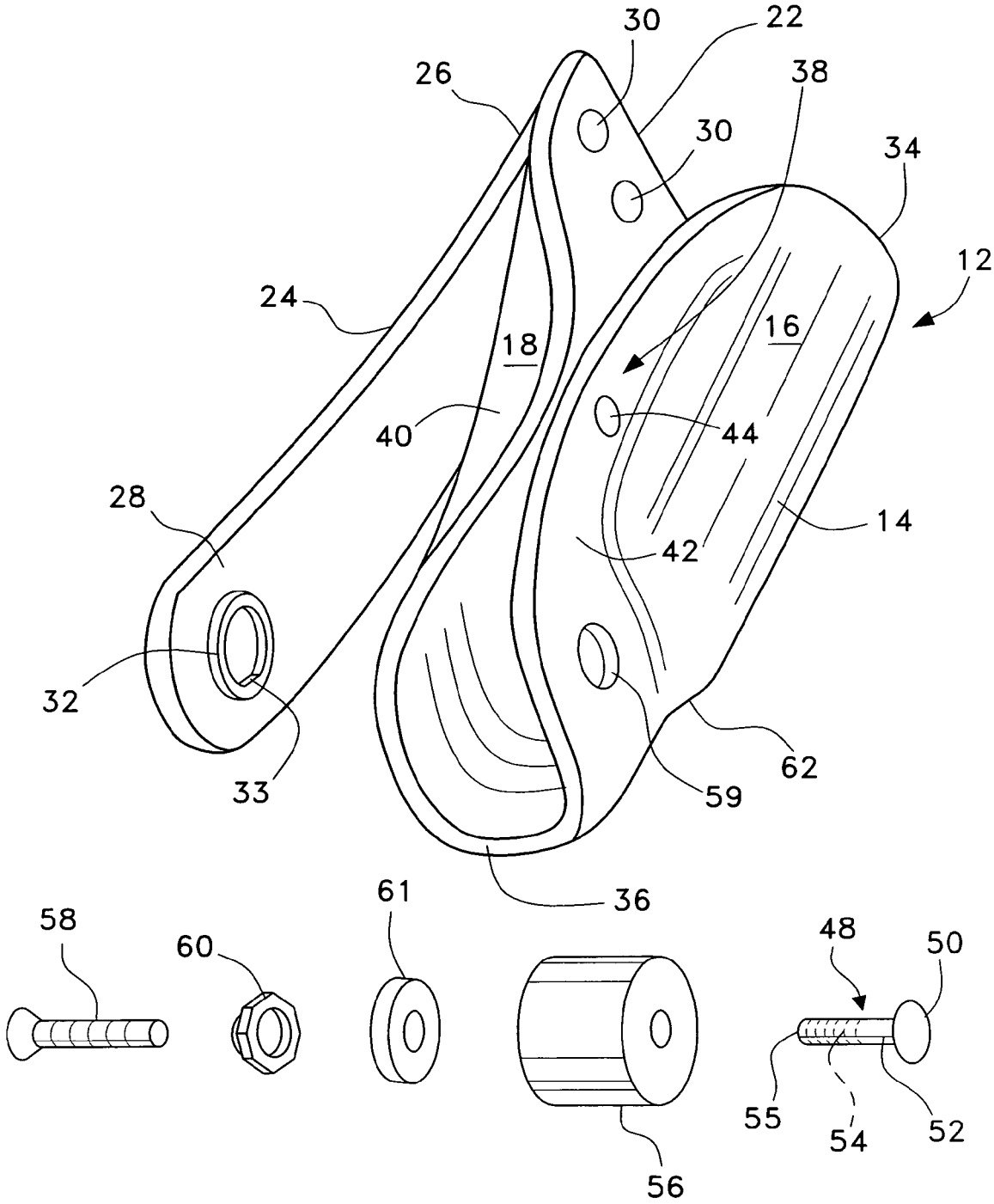
FIG. 6 is a rear exploded view of the holster of FIG. 1.

As seen in FIGS. 5 and 6, an adjustable tension system 46 is spaced below rivet 44 in rear closure portion 38 of holster 12. Tension system 46 adjusts the effective diameter of said front cylindrical portion 14 of said holster, so as to determine the amount of retaining tension exerted by said holster on a flashlight casing C or bezel BZ held therein. Adjustable tension system 46 includes a female pin having a head 50 on outer side closure portion 42, female pin 48 having a female pin shaft 52 extending through outer side closure portion 42 and having inner female threads 54 at its free end 55. A compressible spacer 56 such as a cylinder of rubber or polymeric material surrounds female pin shaft 52 and is located between the inner side closure portion 40 and the outer side closure portion 42 of holster 12.

Figure 7:
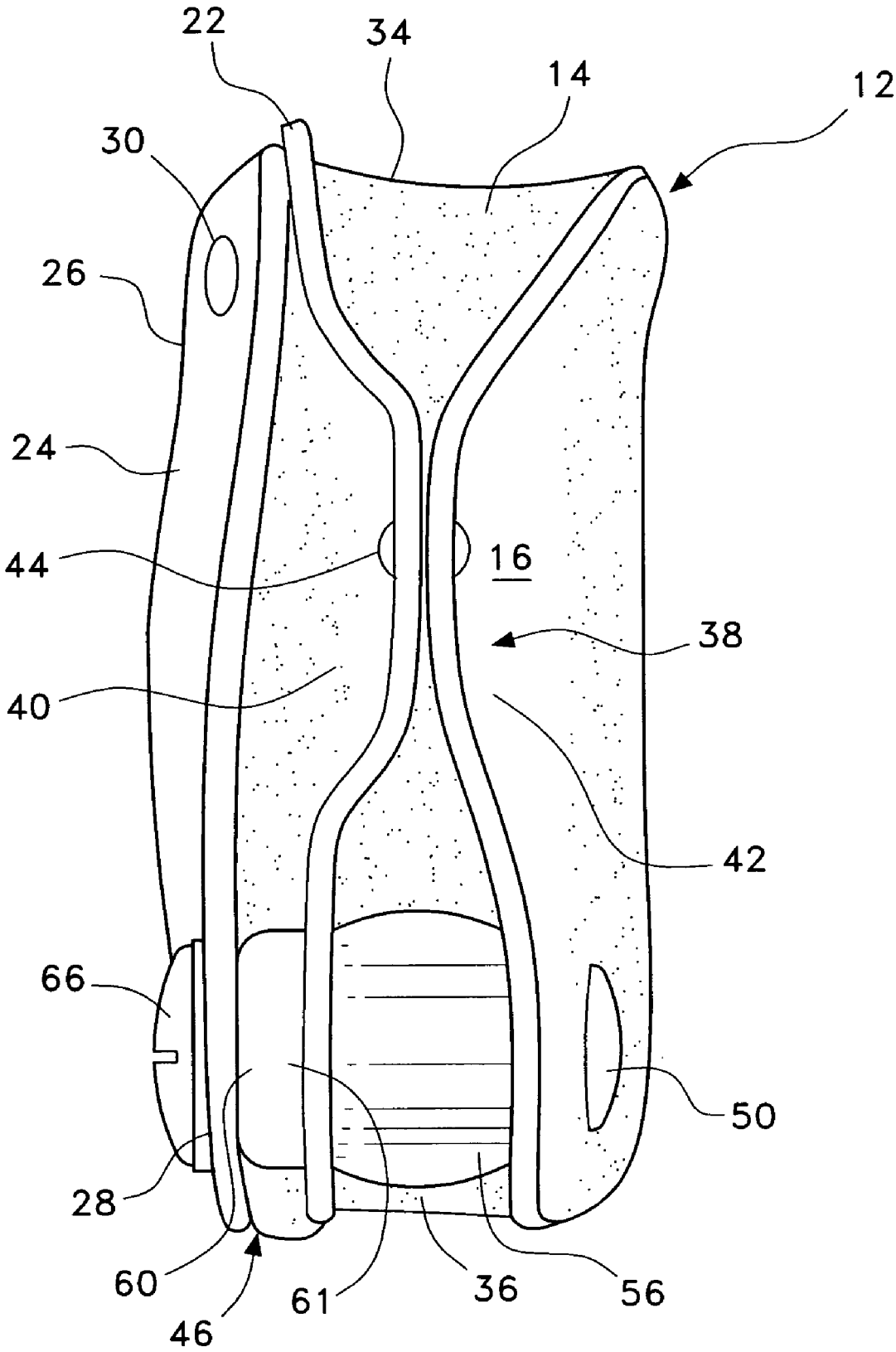
FIG. 7 is a rear elevation view of a holster employing a lengthened screw in place of the snap.

A flat-head screw 58, having threads mating with female pin threads 54, mounts male snap ring 60 to inner side closure portion 40 for engaging one-way snap head portion 32 having flat 33 in its inner rim. A washer 61 of leather or the like may be fitted between the surface of the male snap ring 60 and the surface of inner side closure portion 40 as desired. Flat-head screw 58 extends through a round perforation 59 in inner side closure portion 40. Perforation 59 is of sufficient diameter to allow the free end 55 of female pin shaft 52 to extend therethrough and into the interior of male snap ring 60 as flat-head screw 58 is tightened within female pin shaft 52. The tension applied by the front cylindrical portion 14 to a cylindrical article inserted therein is adjusted by tightening flat-head screw 58, thus compressing spacer 56 and thereby incrementally closing the inner side closure portion toward the outer side closure portion 42 at the holster lower end. As an alternative, the snap head 32 and male snap ring 60 may be deleted and a screw 66 (see FIG. 7) similar to that of flat-head screw 58 may extend directly through belt strap 28 and through inner side closure portion 40 and mate with free end 55 of female pin 48.

The front cylindrical portion 14 may have an inward tapered collar 62 (see FIG. 2) spaced upward from inward-tapered lower end 36 to space an article placed therein from the lower end 36. This is embodiment is useful for flashlights with a tail switch, which, when inserted tail first into the holster 12 protects the tail switch S from being accidentally pressed when carrying bezel-up. This configuration is also useful to protect the flashlight lens when carrying a flashlight with the bezel inserted down within the holster 12. A "twist-on" bezel flashlight can be turned on while the light is still seated in the holster, allowing for one-handed use of the light.

The holster of the present invention may be made of any desired size and length to accommodate a particular flashlight or other elongated article. For a long holster it may be desirable to provide two spaced adjustable tension systems. The holster may be fashioned employing any appropriate fastening means such as rivets as described above or by sewing and all equivalent fastening means are intended to be within the scope of the invention. The shape of the front cylindrical portion may be modified to accommodate an elongate article having a square or rectangular cross section. When fitting the elongate article such as a flashlight barrel or bezel, the leather may be wetted and, through tensioning or other means, stretched to fit the article. The tension may then be reset around the article such that it is securely held in the holster, but relatively easily drawn from the holster for use.

Among the flashlights contemplated for use in the inventive holster are those conventionally having a similar diameter as the cylindrical portion of the inventive holster and are preferably between about 0.75" to about 1.5", but may be of any diameter as desired. Length of the holster cylindrical portion is preferably about 2", but may be of any desired length.

It is to be understood that the present invention is not limited to the embodiments described above, but encompasses any and all embodiments within the scope of the following claims.

I claim:

1. A flashlight holster for mounting on a waist belt at the user's side, comprising:

an outer side;

an inner side;

a front;

a rear closure portion;

a lower end;

said outer side, said inner side and said front defining a front cylindrical portion having an upper end and an inward-tapered lower end;

said inner side having an upper end;

a belt strap having an upper portion and a lower portion;

said belt strap upper portion being attached to said inner side upper end;

said belt strap being fastened at an acute rearward angle relative to said front cylindrical portion;

at least one fastener securing said belt strap upper portion to said inner side upper end of said holster so as to maintain said acute angle therebetween, said at least one fastener includes two spaced rivets and said closure fastener attaching said outer side closure portion and said inner side closure portion is a rivet;

said holster rear closure portion having an outer side closure portion and an inner side closure portion;

at least one closure fastener attaching said outer side closure portion and said inner side closure portion;

said belt strap having at least one releasable fastener at its said lower portion for selectively attaching said belt strap to said inner side closure portion of said holster and spaced below said at least one closure fastener, said releasable fastener including a snap having a female cap portion mounted on said belt strap and a male snap ring affixed to said inner side closure portion of said holster;

said holster further comprising an adjustable tension system for adjusting the effective diameter of said front cylindrical portion of said holster, so as to determine the amount of retaining tension exerted by said holster on a flashlight casing or bezel held therein, said adjustable tension system being attached to said inner side closure portion of said holster and being aligned with said male snap ring; and said inner side of said holster having an aperture therethrough, said tension system comprising a female pin having a head, a shaft, and defining female pin threads within the free end thereof, said female pin extending through said outer side closure portion, a screw extending through said male snap ring and said aperture in said inner side closure portion and threadingly fitting within said female pin threads for inner and outer adjustment relative thereto, and a compressible spacer mounted on said female pin shaft between said inner side closure portion and said outer side closure portion, whereby, upon tightening said screw against said male ring, said free end of said female pin shaft is drawn through said aperture and into said male snap ring, thereby compressing said compressible spacer and drawing said inner side closure portion toward said outer side closure portion, and thereby adjusting said retaining tension on the flashlight casing or bezel therein, whereby said belt strap is looped over and attaches said holster to said belt at the side of a user at a forward rake, allowing for a smooth ergonomic draw of the flashlight.

2. The flashlight holster of claim 1, wherein said fastener securing said belt strap upper portion to said inner side upper end of said holster includes two spaced rivets and said closure fastener attaching said outer side closure portion and said inner side closure portion is a rivet.

3. The flashlight holster of claim 1, said front cylindrical portion having an inwardly tapered collar spaced above said narrowed lower end.

4. The flashlight holster of claim 1, said fastener securing said belt strap upper portion to said inner side upper end of said holster includes two spaced rivets and said closure fastener attaching said outer side closure portion and said inner side closure portion is a rivet.

5. The flashlight holster of claim 1, said front cylindrical portion having an inwardly tapered collar spaced above said narrowed lower end.

6. The flashlight holster of claim 1, wherein said snap is a one-way snap.

7. The flashlight holster of claim 1, said front cylindrical portion having an inwardly tapered collar spaced above said narrowed lower end.

8. The flashlight holster of claim 1, wherein said belt strap upper portion is sewn to said inner side of said holster and said outer closure portion is sewn to said inner closure portion.

9. A flashlight holster for mounting on a waist belt at the user's side, comprising:

an outer side;

an inner side;

a front;

a rear closure portion;

a lower end;

said outer side, said inner side and said front defining a front cylindrical portion having an upper end and an inward-tapered lower end;

said inner side having an upper end;

a belt strap having an upper portion and a lower portion;

said belt strap upper portion being attached to said inner side upper end, wherein said belt strap upper portion is sewn to said inner side of said holster and said outer closure portion is sewn to said inner closure portion;

said belt strap being fastened at an acute rearward angle relative to said front cylindrical portion;

at least one fastener securing said belt strap upper portion to said inner side upper end of said holster so as to maintain said acute angle therebetween;

said holster rear closure portion having an outer side closure portion and an inner side closure portion;

at least one closure fastener attaching said outer side closure portion and said inner side closure portion;

said belt strap having at least one releasable fastener at its said lower portion for selectively attaching said belt strap to said inner side closure portion of said holster and spaced below said at least one closure fastener, said releasable fastener including a snap having a female cap portion mounted on said belt strap and a male snap ring affixed to said inner side closure portion of said holster; and said holster further comprising an adjustable tension system for adjusting the effective diameter of said front cylindrical portion of said holster, so as to determine the amount of retaining tension exerted by said holster on a flashlight casing or bezel held therein, said adjustable tension system being attached to said inner side closure portion of said holster and being aligned with said male snap ring;

whereby said belt strap is looped over and attaches said holster to said belt at the side of a user at a forward rake, allowing for a smooth ergonomic draw of the flashlight.

* * * * *